US010136685B2

(12) United States Patent
Beck

(10) Patent No.: US 10,136,685 B2
(45) Date of Patent: Nov. 27, 2018

(54) TACTICAL HAND WARMER APPARATUS

(71) Applicant: TYR TACTICAL, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 14/522,825

(22) Filed: Oct. 24, 2014

(65) Prior Publication Data

US 2016/0113335 A1 Apr. 28, 2016

(51) Int. Cl.
*A41D 13/08* (2006.01)
*A41D 19/00* (2006.01)

(52) U.S. Cl.
CPC ..... *A41D 13/08* (2013.01); *A41D 13/081* (2013.01)

(58) Field of Classification Search
CPC ..... A41D 13/08; A41D 13/081; A41D 19/01; A41D 19/002; A41D 19/0034; A41D 19/01594; A41D 19/0048; A41D 19/001; A41D 19/0041; A41D 19/0037; A41D 19/0044; A41D 19/0003; A41D 19/0082; A41D 19/0093; A41D 19/01552
USPC ..... 2/16, 66, 910, 158, 159, 160
See application file for complete search history.

(56) References Cited

U.S. PATENT DOCUMENTS 1,507,707 A * 9/1924 Morganstern ..... A47K 7/02 15/227
2,321,091 A * 6/1943 Kertesz ..... A41D 13/081 2/159
2,611,901 A * 9/1952 Neider ..... A41D 19/01 126/204
4,408,355 A 10/1983 Brock
4,426,739 A * 1/1984 Wadsworth ..... A41D 13/08 2/16
4,495,659 A 1/1985 Madnick
4,543,671 A * 10/1985 Monk ..... A41D 19/01535 2/158
5,139,187 A * 8/1992 Fowler ..... A41D 13/081 2/162
D366,131 S * 1/1996 Smith ..... D2/610
5,682,610 A * 11/1997 Warner ..... A41D 19/01 2/158
6,385,775 B1 * 5/2002 Komjati ..... A41D 15/04 2/86
2010/0299800 A1 * 12/2010 Jackson, Jr. ..... A41D 13/081 2/69

(Continued)

FOREIGN PATENT DOCUMENTS

DE 9409402 8/1994

OTHER PUBLICATIONS

Extended European Search Report in corresponding Euriopean App No. 15151336.3 dated Mar. 29, 2016.

(Continued)

*Primary Examiner* — Bobby Muromoto, Jr.
(74) *Attorney, Agent, or Firm* — Mark Williams

(57) ABSTRACT

Embodiments of a tactical hand warmer apparatus having a first glove portion defining a first glove recess that is detachably connected to a second glove portion defining a second glove recess for allowing an individual to warm their hands within the first and second glove recesses either closely together when the first and second glove portions are attached or apart when the first and second glove portions are detached are disclosed.

11 Claims, 6 Drawing Sheets

(56) References Cited

U.S. PATENT DOCUMENTS

| | | | | |
|---|---|---|---|---|
| 2011/0155076 | A1* | 6/2011 | Charette | A01K 27/00 119/795 |
| 2012/0042428 | A1* | 2/2012 | Jarboe | A41D 13/085 2/16 |
| 2013/0160185 | A1* | 6/2013 | Narboni-Campora | A41D 13/085 2/158 |
| 2014/0173804 | A1* | 6/2014 | Matos | A45F 5/06 2/158 |

OTHER PUBLICATIONS

Gemma: *Flutter and Sparkle: A very Wintry OOTD with Joe Browns;* Dec. 27, 2011 www.flutterandsparkle.com/2011/12/very-wintry-ooted-with-joe-browns.html.

* cited by examiner

TACTICAL HAND WARMER APPARATUS

FIELD

The present disclosure generally relates to hand warmer apparatus, and in particular to a hand warmer apparatus having two separable hand warming portions.

BACKGROUND

Typically, tactical hand warmers may be single-piece muffs with opposing open ends that permit a soldier to insert their hands closely together to keep them warm. However, the demands of a combat or tactical environment may require the individual to maintain their hands apart from each other, rather than being closely held together in the single-piece muff. As such, there is a need for a tactical hand warmer that permits the soldier to maintain their hands either closely together or far apart to keep them warm.

SUMMARY

In some embodiments, a tactical hand warmer apparatus may include a first glove portion defining a first open end and a second closed end, wherein the first open end forms a first opening in communication with a first glove recess defined by the first glove portion and configured to receive a hand of an individual. In addition, the tactical warmer apparatus includes second glove portion defining a first open end and a second closed end, wherein the first open end forms a second opening in communication with a second glove recess defined by the second glove portion and configured to receive another hand of the individual. Finally, a securing arrangement extends along a first end portion of the first glove portion and the second end portion of the second glove portion for engaging or disengaging the first glove portion and the second glove portion.

In some embodiments, a method of manufacturing a tactical hand warmer apparatus may include:

- forming a first glove portion defining a first open end and a second closed end wherein the first open end forms a first opening in communication with a first glove recess defined by the first glove portion;
- forming a second glove portion defining a first open end and a second closed end wherein the first open end forms a second opening in communication with a second glove recess defined by the second glove portion; and
- forming a securing arrangement for detachably coupling the first glove portion relative to the second glove portion.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
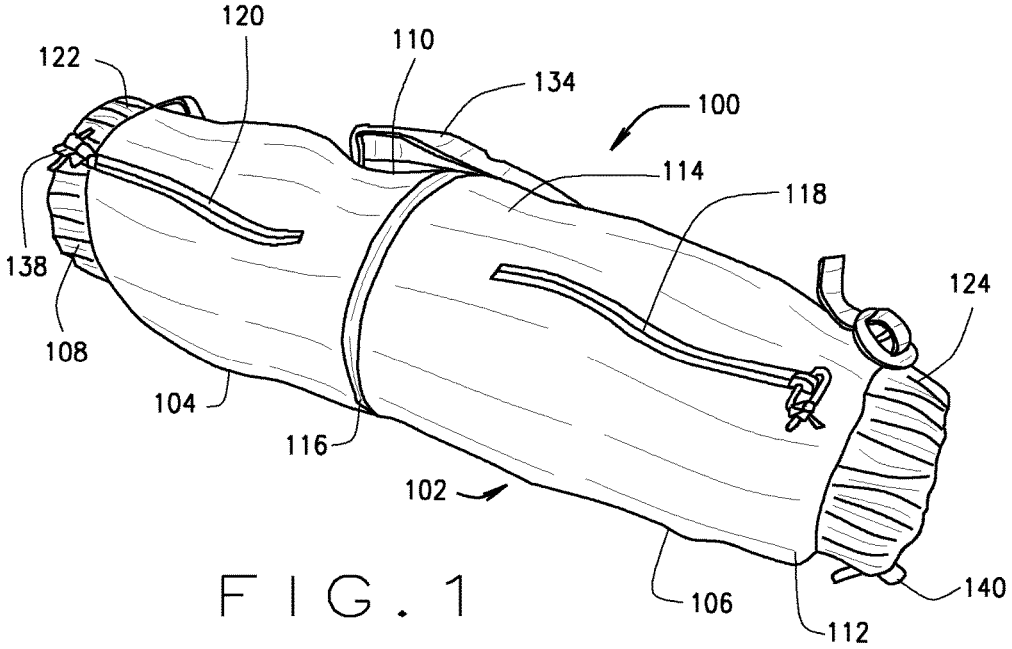
FIG. 1 is a perspective view of a tactical hand warmer apparatus having first and second glove portions secured together.

Embodiments of a tactical hand warmer apparatus having detachable first and second glove portions that allow an individual to warm their hands either separately or closely together within the body of the tactical hand warmer apparatus are disclosed. Referring to the drawings, an embodiment of the tactical hand warmer apparatus is illustrated and generally indicated as 100 in FIGS. 1-10.

Figure 2:
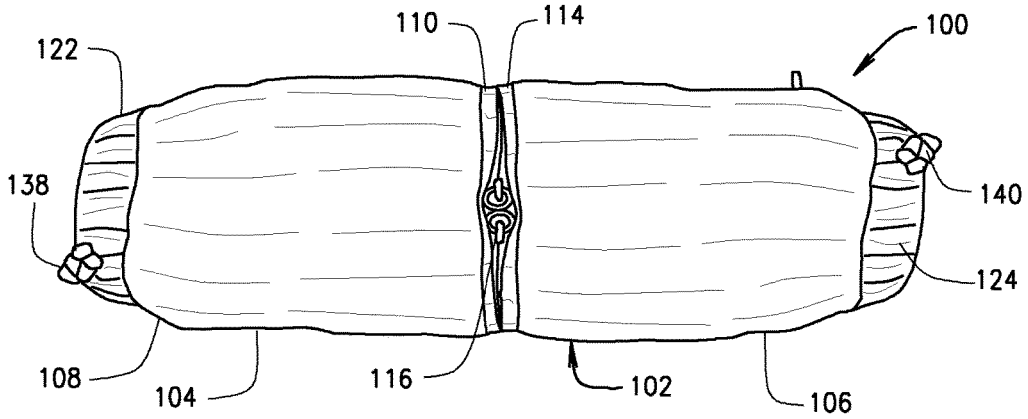
FIG. 2 is a top view of the tactical hand warmer apparatus.

As shown in FIGS. 1 and 2, one embodiment of the tactical hand warmer apparatus 100 includes a detachable body 102 having a first glove portion 104 detachably secured to a second glove portion 106 through a first securing arrangement 116. In one embodiment, the first securing arrangement 116 permits the first glove portion 104 to be engaged or disengaged from the second glove portion 106 when the first securing arrangement 116 is closed or opened to permit an individual to either keep their hands in close proximity to each together within the body 102 of the tactical hand warmer apparatus 100 or maintained apart from each other while still maintaining both hands within the body 102 of the tactical hand warmer apparatus 100.

Figure 3:
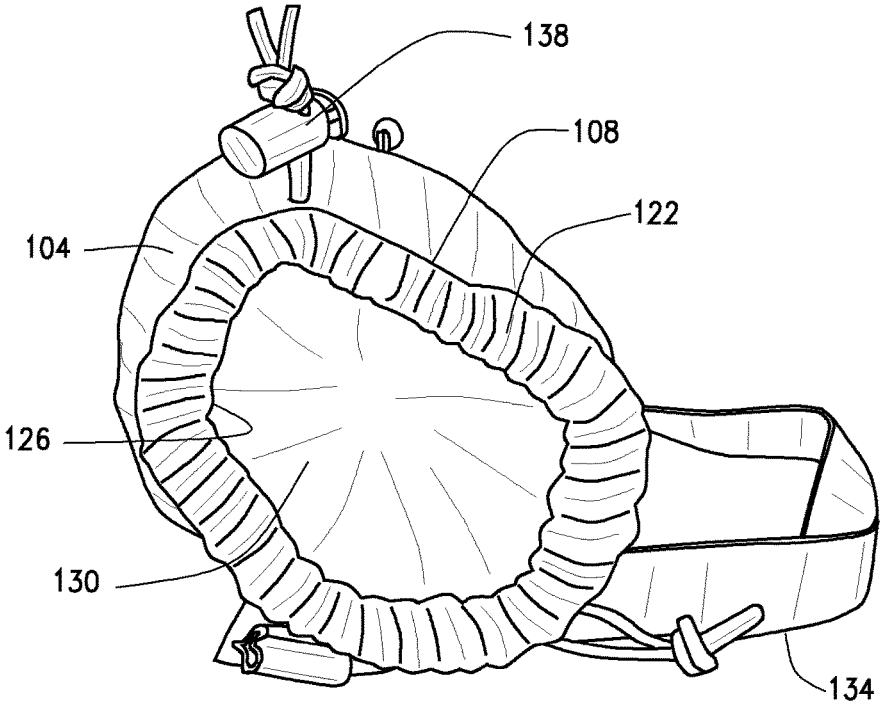
FIG. 3 is an end view of the tactical hand warmer apparatus.
Figure 4:
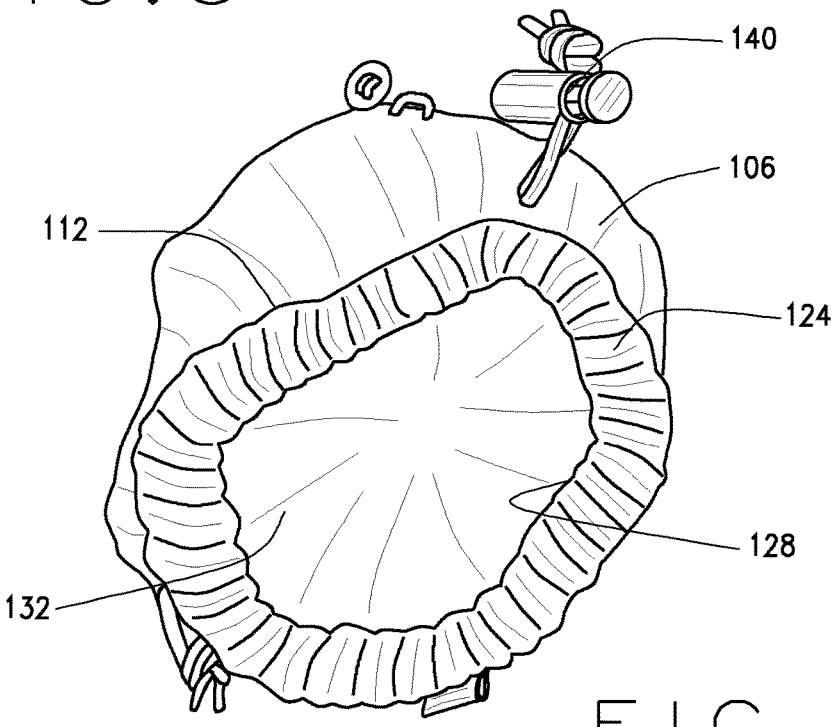
FIG. 4 is an opposite end view of the tactical hand warmer apparatus of FIG. 3.
Figure 5:
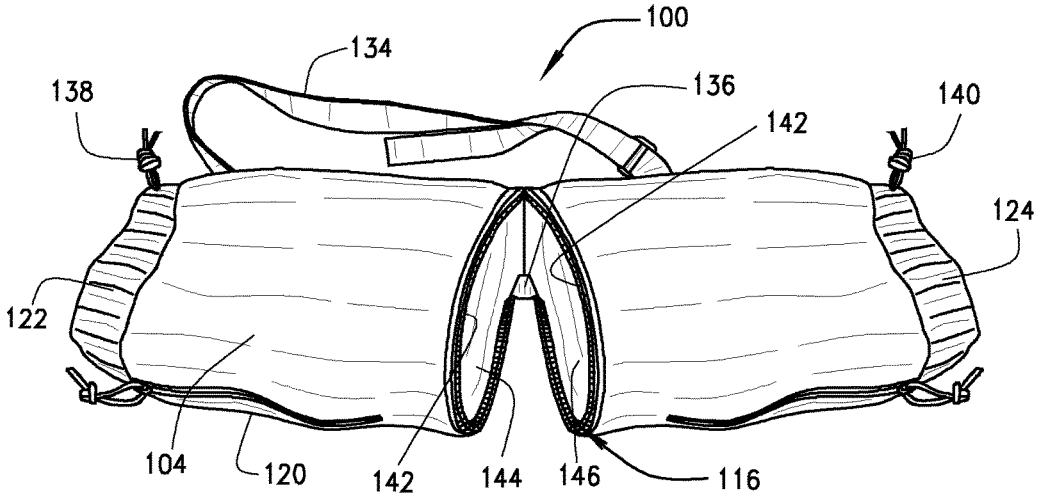
FIG. 5 is an elevated perspective view of the tactical hand warmer apparatus showing the first and second hand glove portions partially secured together.

In one aspect, the first glove portion 104 defines a first open end 108 and a second closed end 110, while the second glove portion 106 also defines a first open end 112 and a second closed end 114. As shown in FIG. 3, the first open end 108 of the first glove portion 104 forms an opening 126 that communicates with a first glove recess 130 configured to receive one hand of an individual. Similarly, as shown in FIG. 4, the first open end 112 of the second glove portion 106 forms an opening 128 that communicates with a second glove recess 132 configured to receive the other hand of the individual. In some embodiments, the first and second glove recesses 130 and 132 may be lined with a felt material, a synthetic fur material, and/or a natural fur material that provide warmth to the hands when disposed within the first and second glove recesses 130 and 132 of the tactical hand warmer apparatus 100.

As further shown in FIGS. 3 and 4, in some embodiments the first open end 108 of the first glove portion 104 defines a first cuff 122 configured to receive a first drawstring 138 that permits the individual to closely draw the first cuff 122 around the wrist of an individual as the first drawstring 138 is drawn closed. Similarly, the first open end 112 of the second glove portion 106 defines a second cuff 124 configured to receive a second drawstring 140 that also permits the individual to closely draw the second cuff 124 around the other wrist of the individual as the second drawstring 140 is drawn closed.

Figure 6:
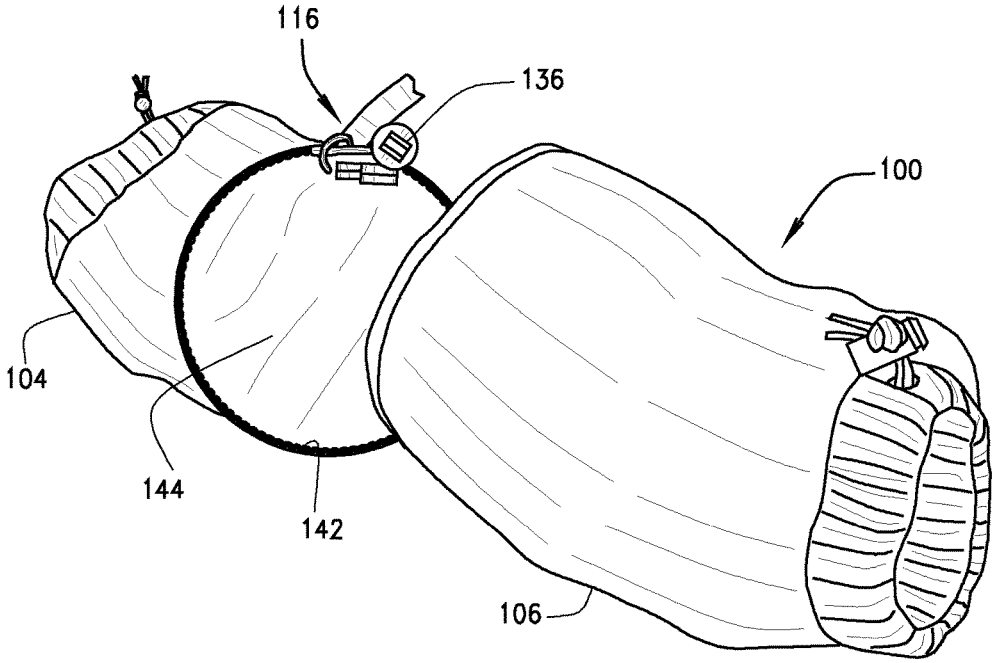
FIG. 6 is a perspective view of the tactical hand warmer apparatus showing the first and second glove portions separated from one another.
Figure 7:
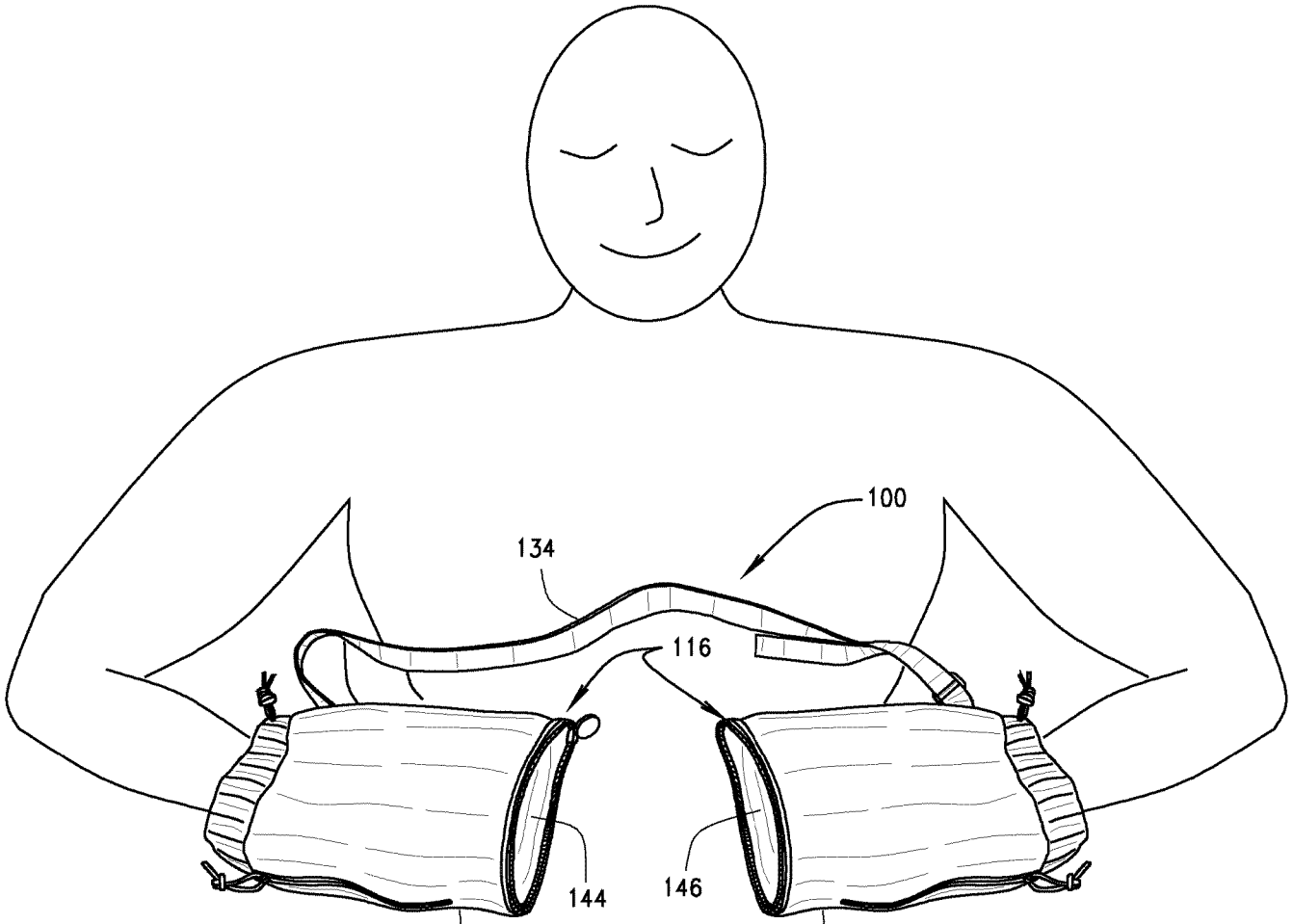
FIG. 7 is a top view of the tactical hand warmer apparatus showing the first and second glove portions separated from one another.
Figure 8:
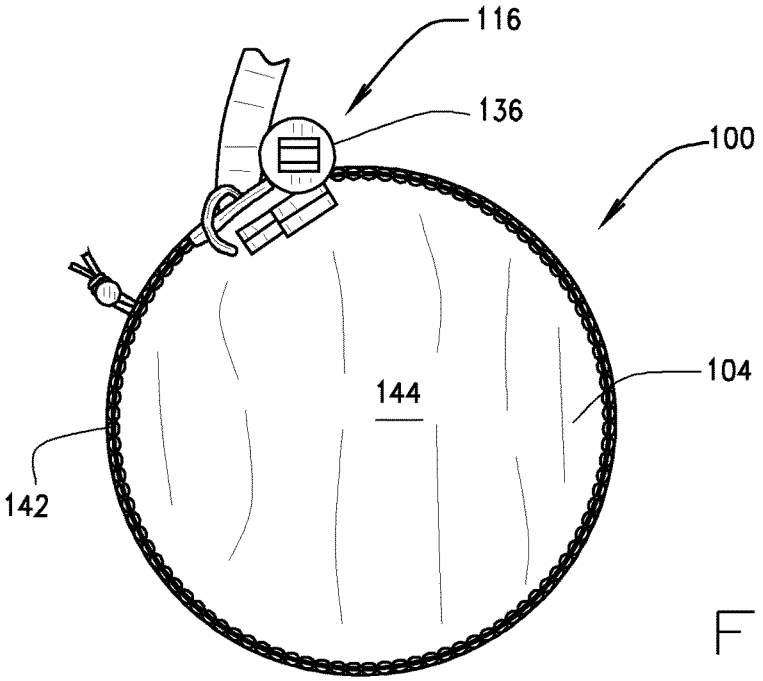
FIG. 8 is an end view of the first glove portion showing a securing arrangement used to couple the first glove portion to the second glove portion.
Figure 9:
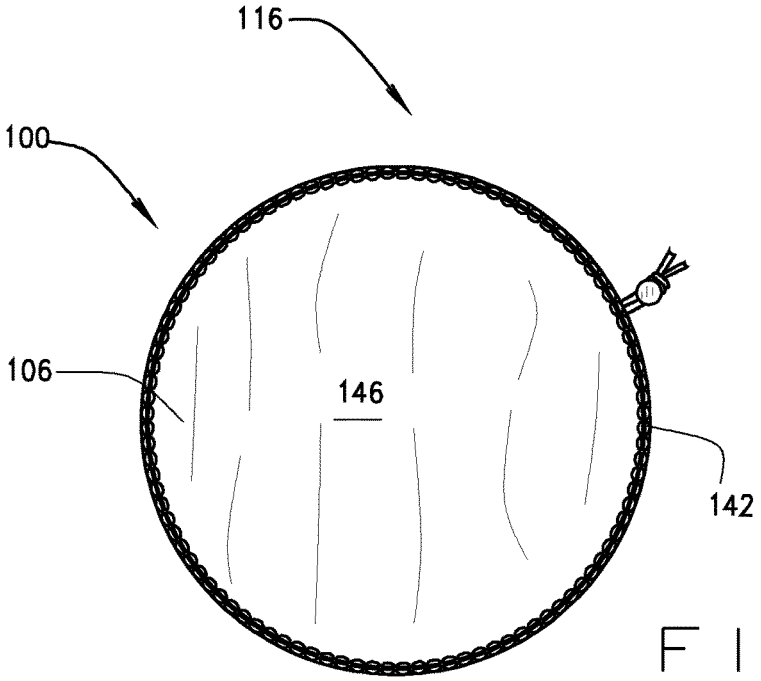
FIG. 9 is an end view of the second glove portion showing the securing arrangement used to couple the first glove portion to the second glove portion.

Referring to FIGS. 5-9, as noted above, in some embodiments the closed first end 110 defining a generally circular-shaped first end portion 144 defined by the first glove portion 104 and the closed second end 114 also defines a generally circular-shaped second end portion 146 of the second glove portion 106 collectively form the first securing arrangement 116 that allows the first glove portion 104 to be engaged and disengaged from the second glove portion 106. In particular, as shown in FIGS. 7 and 8, the first securing arrangement 116 may be a zipper arrangement that includes a set of interlocking protruding teeth 142 formed along the periphery of the first end portion 144 and another set of interlocking protruding teeth 142 formed along the periphery of the second end portion 146. The first securing arrangement 116 further includes a slider 136 that is operatively connected to both sets of interlocking protruding teeth 142 such that movement of the slider 136 in one direction opens the first securing arrangement 116 by disengaging both sets of interlocking protruding teeth 142 and movement of the slider 136 in the opposite direction closes the first securing arrangement 116 by engaging together both sets of interlocking protruding teeth 142. Once the first securing arrangement 116 is fully opened as shown in FIG. 6, the first and second glove portions 104 and 106 may be detached from each other such that each of the individual's hands are separately disposed within the first glove portion 104 and second glove portion 106, respectively, as illustrated in FIG. 7.

Referring back to FIG. 1, in some embodiments the first glove portion 104 may define a second securing arrangement 120 that extends longitudinally between the first open end 138 and the second closed end 110 of the first glove portion 104. Similarly, the second glove portion 106 may define a third securing arrangement 118 that extends longitudinally between the first open end 112 and the second closed end 114 of the second glove portion 106. The second securing arrangement 120 and the third securing arrangement 118 may communicate with a respective internal pouch (not shown) that provides a closable storage area.

Referring back to FIG. 7, in some embodiments the tactical hand warmer may include a strap 134 having one end attached to the first glove portion 104 and the opposite end attached to the second glove portion 106. The strap 134 provides a tether that couples the first and second glove portions 104 and 106 together.

In some embodiments, the first securing arrangement 116 may be a strap and buckle arrangement (not shown) that engages and disengages the first and second glove portions 104 and 106. In other embodiments, the first securing arrangement 116 may be a loop and hook arrangement (not shown), such as VELCRO, that extends around the periphery of the first closed end 144 and second closed end 146, respectively, for engaging and disengaging the first and second glove portions 104 and 106.

Figure 10:
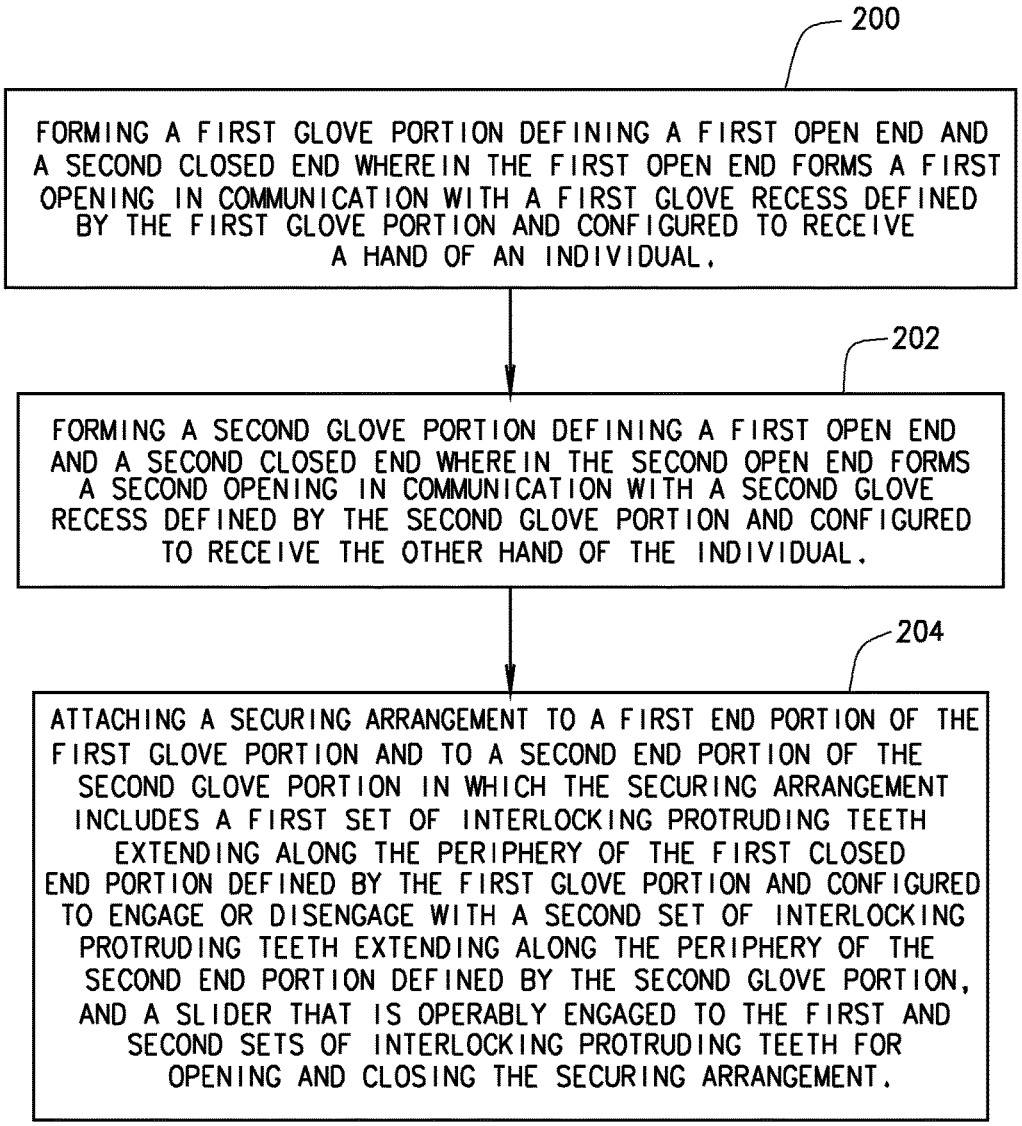
FIG. 10 is a flow chart showing one method of manufacturing the tactical hand warmer apparatus of FIG. 1.

Referring to FIG. 10, a flow chart illustrates one method for manufacturing the tactical hand warmer apparatus 100. At block 200, forming a first glove portion 104 defining a first open end 108 and a second closed end 110 wherein the first open end 108 forms a first opening 126 in communication with a first glove recess 130 defined by the first glove portion 104 and configured to receive a hand of an individual. At block 202, forming a second glove portion 106 defining a first open end 112 and a second closed end 114 wherein the first open end 112 forms a second opening 128 in communication with a second glove recess 132 defined by the second glove portion 106 and configured to receive the other hand of the individual. At block 204, attaching a securing arrangement 116 for detachably coupling the first glove portion 104 to the second glove portion 106 in which the securing arrangement 116 includes a first set of interlocking protruding teeth 104 extending along the periphery of a first end portion 144 defined by the first glove portion 104 which is configured to engage or disengage a second set of interlocking protruding teeth 142 extending along the periphery of the second end portion 146 defined by the second glove portion 106, and a slider 136 that is operably engaged to the first and second sets of interlocking protruding teeth 142 for opening and closing the securing arrangement 116.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A tactical hand warmer apparatus comprising:

a detachable body extending from a first end to a second end along a longitudinal axis;

a first recess disposed within the detachable body and accessible through an opening at the first end, the first recess extending from the opening to a first end portion along the longitudinal axis, the first end portion extending transverse to the longitudinal axis;

a second recess disposed within the detachable body and accessible through an opening at the second end, the second recess extending from the opening at the second end to a second end portion along the longitudinal axis, the second end portion extending transverse to the longitudinal axis and parallel to the first end portion;

a first closed end associated with the first end portion of the first recess;

a second closed end associated with the second end portion of the second recess, the first closed end disposed adjacent to the second closed end; and a zipper having a first zipper portion attached to the first end portion and extending around a first center of the first end portion and a second zipper portion attached to the second end portion and extending around a second center of the second end portion, the first center and the second center each positioned on the longitudinal axis, the zipper releasably securing the first closed end to the second closed end, release of the first closed end from the second closed end separating a first glove portion of the detachable body from a second glove portion of the detachable body.

2. The tactical hand warmer apparatus of claim 1, wherein the detachable body includes one or more pouches.

3. The tactical hand warmer apparatus of claim 2, wherein the one or more pouches includes a first pouch disposed along the detachable body near the first recess and a second pouch disposed along the detachable body near the second recess.

4. The tactical hand warmer apparatus of claim 1, wherein the first recess and the second recess each include a lining.

5. The tactical hand warmer apparatus of claim 4, wherein the lining includes at least one of a felt material, a synthetic fur material, or a natural fur material.

6. The tactical hand warmer apparatus of claim 1, wherein the opening at the first end and the opening at the second end are each closeable using a drawstring.

7. A tactical hand warmer apparatus comprising:

a first glove portion extending from a first end to a second end;

an opening at the first end forming a cuff, a size of the opening being adjustable;

an end portion at the second end, the end portion having a planar surface extending transverse to a length of the glove portion;

a glove recess disposed within the first glove portion and accessible through the opening; and a zipper releasably engaging the first glove portion to a second glove portion, the zipper extending about a periphery of the planar surface, such that the zipper is oriented transversely to the length of the glove portion.

8. The tactical hand warmer apparatus of claim 7, wherein the size of the opening is adjustable using a drawstring.

9. The tactical hand warmer apparatus of claim 7, wherein the zipper releasably engages the second end of the first glove portion to a corresponding end of the second glove portion.

10. A tactical hand warmer apparatus comprising:

a detachable body extending from a first end to a second end along a longitudinal axis;

a first end wall disposed adjacent to a second end wall, the first end wall and the second end wall each extending transverse to the longitudinal axis of the detachable body and parallel to each other;

a first opening defined at the first end;

a second opening defined at the second end;

a first recess extending from the first opening to the first end wall;

a second recess extending from the second opening to the second end wall;

a first closed end releasably secured to a second closed end with a securing arrangement, the securing arrangement having a first securing portion attached to the first wall and extending about a first center of the first end wall and a second securing portion extending about a second center of the second end wall, the first center and the second center each positioned on the longitudinal axis, release of the first closed end from the second closed end separating a first glove portion of the detachable body from a second glove portion of the detachable body.

11. The tactical hand warmer apparatus of claim 10, wherein the securing arrangement is a zipper.

* * * * *